US005150921A

United States Patent [19]

Broyles

[11] Patent Number: 5,150,921

[45] Date of Patent: Sep. 29, 1992

[54] FREE-ENDED BOOK MARK

[76] Inventor: Horace N. Broyles, 6981 Arbor Dr., Frederick, Md. 21701

[21] Appl. No.: 744,353

[22] Filed: Aug. 12, 1991

[51] Int. Cl.[5] ..... B42D 9/00

[52] U.S. Cl. ..... 281/42; 281/45

[58] Field of Search ..... 281/42, 45, 51, 15.1; 24/67 R, 67 P

[56] References Cited

U.S. PATENT DOCUMENTS 2,224,703 12/1940 Spencer ..... 281/42

FOREIGN PATENT DOCUMENTS 348531 2/1922 Fed. Rep. of Germany ..... 281/42
4216 of 1881 United Kingdom ..... 281/42
153735 6/1920 United Kingdom ..... 281/42

*Primary Examiner*—Timothy V. Eley
*Assistant Examiner*—Willmon Fridie, Jr.
*Attorney, Agent, or Firm*—Kalish & Gilster

[57] ABSTRACT

For marking a particular location in a book, there is provided an elongated, stiff but flexible, moisture-resistant book mark which extends through a series of aligned apertures punched, or otherwise provided within the pages of a book and is thereby engaged with the book during use. The marker is provided with one free end for passing through the apertures and with a second end having an element fixed thereto of greater cross section than the apertures for anchoring the book mark to the book and the length of said marker is substantially greater than the thickness of the book. If desired, more than one such marker may be provided within the book to permit marking of spaced apart locations therein for reference purposes.

5 Claims, 2 Drawing Sheets

FREE-ENDED BOOK MARK

BACKGROUND OF THE INVENTION

1. Field of the Invention

The present invention generally relates to book marks, and more particularly, to a book mark having an end which is free to move through aligned apertures provided in a book and an end adapted for anchoring the book mark within the book.

2. Brief Description of the Prior Art

Generally speaking, a variety of devices for holding pages of a book open at a desired place or for marking a specific location in a book are well-known. Book marks are known which have one free end and a second end fixed as by gluing, stapling or stitching, for example, to a book so that the book mark is always available with the associated book. Examples of these are U.S. Pat. No. 1,802,081 to A. W. Kelly and U.S. Pat. No. 2,591,094 to J. O'Neill. The device of Kelly includes a wire member between the book binding and the back of the leaves having hinged to it another member, which may also be of wire, for swinging down between the book pages. The patent to O'Neill discloses a book mark consisting of a string secured at one end to a patch which is in turn glued to the inside of the front cover of the book. In each case, because of the materials involved and because the book mark is fixed to the book, or to a book jacket, there is considerable time and expense involved with publishing the book with the associated book mark. Also, neither O'Neill nor Kelly teaches a book mark having an end which is free to penetrate through apertures provided in the book as does the new book mark.

A few book marks have been known which penetrate through the pages of a book. Examples of these are British Pat. Nos. 601,722 to Manzardo, 153,735 to Fraser and 15,561 to Penman.

Fraser illustrates a ribbon penetrating book pages and adjustably secured on each end by a tab through which the ribbon may be strung. This book mark is capable of pulling free from the tabs on each end and thereafter dropping from a book. Also, ribbon is necessarily subject to mildew and rotting, which will necessarily shorten the life of the book to be marked therewith.

British Pat. No. 601,722 to Manzardo claims an automatic book marker which consists of a tape integrally attached to anchoring cross pieces at each of its ends. The teachings of Manzardo indicate that such tape penetrates through the pages of the book and is of a finite length. The Manzardo book marker length is constant throughout the entire edition of a book. The cross pieces of the book marker are made integral with the tape out of a single piece of soft, pliable cloth material so that they can be folded and drawn through the perforations in the pages. It may be readily seen that such manipulation of ribbon and pages, especially on a repeated basis, will quickly cause damage to the book pages and that further such handling is awkward and time consuming.

Penman describes a book mark which is sewn or otherwise fixed at the ends thereof to the book. It is formed of cord or ribbon which passes through the book and is preferably of silk or other soft, flexible material. As with the previously described book marks, that of Penman is subject to rotting and eventually contributing to spoiling of the book.

Also, many other different designs of book marks exist which typically include several distinct components which may be costly in production, and may also require maintenance. In normal, everyday usage, because they are not engageable with the book, some of these devices may be accidentally detached or displaced from the book, thereby greatly diminishing functionality. Others, as previously discussed, are subject to wear, mildew and rotting over time.

There is a need for an inexpensive book mark of indeterminate length that is effectively engageable to the book and may be readily manipulated without causing damage to the book or its pages. The use of such a book mark will prevent misuse of books such as is a common habit of many readers wherein the corner of a page is folded over to indicate location, or the back of the book is broken by being left in a forced-open position to mark a page. Furthermore, the invention permits utilization of more than one such marker for indicating different locations within a book. It is, therefore, desirable to provide a book mark that will combine the features of low cost in manufacturing and thus to the consumer, while at the same time being effectively engageable with the book for reliable usage.

SUMMARY OF THE INVENTION

Accordingly, it is among the several objects of the present invention to provide an inexpensive and simple book mark that can be provided either independently or integrally with the associated book, the mark not being fixed to the book but adapted for anchoring thereto. It is intended that the book mark be constructed of plastic or other material so as to be thin, elongated and stiff, yet capable of flexing and provided with one end which is at all times free and capable of passage through apertures provided in a book, and having another end adapted for anchoring the book mark in abutting relationship to the book.

It is a further object of this invention to provide a book mark that is adapted for disposition at various locations within a book so as to mark spaced apart points of reference.

It is yet another object of the present invention to provide a book mark which is of minimal weight and bulk so as to discourage damage to the book housing such marker.

It is a still further object of this invention to provide a book mark that may be constructed by facile economic manufacturing means and will be of exceedingly inexpensive material which is moisture-resistant or moisture-proof.

It is another object of this invention to provide a book mark that is durable in usage, which is easily manipulated, and which, by reason of its association with the corresponding book, is at all times available for ready usage.

Therefore, in furtherance of the above objects, the present invention consists of a book mark which is adapted to permit adjustable affixation to a book; being designed for extending through pages thereof. Thus, the body of the book (composed of the pages) is provided with at least one series of aligned openings for threading through of the book mark which is fabricated of durable, stiff material which is capable of flexing and has an enlargement fixed to one end thereof so as to inhibit inadvertent displacement from the book, yet permitting intentional removal therefrom. The series of aligned openings may be provided at any location lengthwise of the pages, although it has been found that with a single series of such holes, the same is more conveniently located proximate to the upper edge of the page, substantially adjacent to the center of the book. The book mark has an indefinite length substantially greater than the thickness of the body of book pages so that such extra length is easily retained within the book at the particular page to be marked for future reference.

Manifestly, as indicated, there may be a plurality of such markers located in different zones along the length of pages so that at least two different locations may be simultaneously marked. By these means the present invention is especially adapted for reference book usage wherein often times numerous spaced apart portions of the text are to be indicated for the reader's reference.

Briefly, the present invention is a free-ended book mark for use with a book provided with a series of aligned apertures through the pages thereof. The book mark is composed of a moisture resistant, thin, elongated, stiff body adapted for reasonable flexibility and extends between first and second opposed ends. The first end and the elongated body each have a diameter less than than a diameter of the apertures of the book so that the first end is at all times free to move through the apertures. The second end has an element fixed thereto of substantially greater cross section than the diameter of the apertures for anchoring the book mark within the book. Thus there is provided a book mark the first end and elongated body of which may be easily selectively threaded through the aligned apertures for marking a predetermined page of the book while while the anchoring element simultaneously retains the book mark within the book.

The invention is also, briefly the combination of a book and a book mark, wherein the combination includes a book having front and back covers and a body of a predetermined number of pages contained therebetween. The book pages each have an upper edge, a lower edge, and an inner margin. The book has at least one series of aligned apertures provided through the book pages so as to form a continuous passage at least partially through the book. The combination also includes a book mark which is resistant to moisture and of thin, elongate, stiff character and which is adapted for reasonable flexibility. The book mark is threaded through the series of apertures in the book body and has an anchoring element fixed to one end, the element being of greater cross section than the diameter of the apertures so as to be incapable of passage therethrough and thereby to anchor the book mark within the book. Another end of the book mark is at all times free to pass through the apertures as being of smaller cross section than the diameter of the apertures. The book mark has a length substantially greater than the thickness of the length of the passage formed by the apertures.

DETAILED DESCRIPTION OF THE PREFERRED EMBODIMENT

Figure 1:
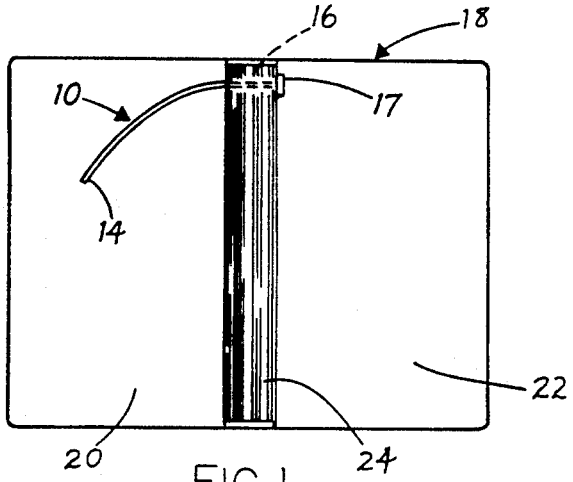
FIG. 1 is a front plan view showing a book having positioned therein a book mark constructed in accordance with and embodying the present invention.
Figure 2:
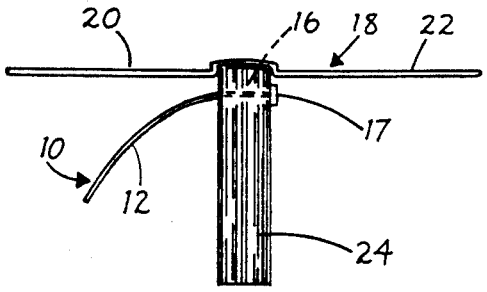
FIG. 2 is a top plan view of the book mark shown in FIG. 1
Figure 3:
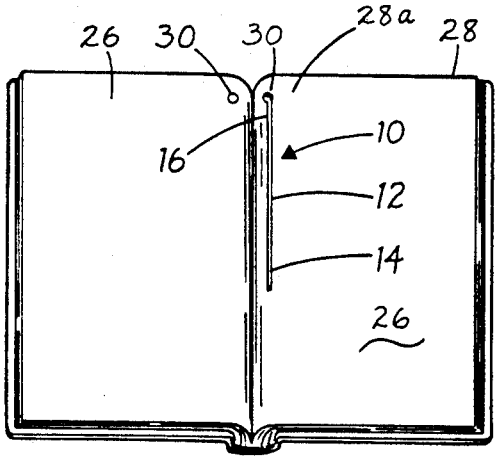
FIG. 3 is a front plan view showing the book mark disposed, in operative position, at a desired location within a book.

Referring now by reference characters to the drawings, and, more particularly to FIGS. 1, 2, and 3; 10 designates the preferred embodiment of a book mark constructed in accordance with and embodying the present invention. Book mark 10 is constructed of a stiff but flexible, thin, elongated filament 12 which extends between and terminates at opposed ends 14, 16 and is preferably composed of plastic for durability and waterproofness. End 14 is at all times free in relation to associated book 18 and is preferably of the same diameter as filament 12 or smaller for use as hereafter described, and end 16 has an anchoring element 17 consisting of a short piece of stiff plastic filament, attached perpendicularly thereto. This form of anchoring element 17 is for facile closing of the associated book without causing damage thereto over years of use and to avoid causing any unsightly bulging of the book covers.

FIGS. 1 and 2 illustrate a book 18 with book mark 10 positioned therein. Book 18 incorporates a front cover 20, and a back cover 22. Presented therebetween is a book body 24 comprising a predetermined number of pages 26. Spacedly downward from the upper end 28 of each page 26, substantially adjacent the inner margin 28*a* thereof, is an aperture 30; which apertures 30 are aligned to form a continuous passage through page 26 of book body 24.

Threaded through apertures 30 of pages 26 is filament 12 of book mark 10 such that book mark 10 is fully within the covers 20, 22 of book 18. Relatively enlarged anchoring element 17 of book mark 10 has a width greater than the cross-sectional extent of apertures 30 such that anchoring element 17 can not be pulled therethrough. Thus although end 14 can readily move in either direction through apertures 30, book mark 10 as a whole can only be entirely withdrawn from book 18 in one direction, thereby reducing the occasion for accidental dislodgement of book mark 10 from the associated book 18.

Anchoring element 17 may be of any imaginable desired character such as knots, knot-simulative character, or cross arms, as with plastic filaments, as long as a cross section thereof is large enough to prevent element 17 from passing through holes 30, so that the mark 10 may not be displaced from the associated book 18 through inadvertency. For example, rather than the T-shape formed by element 17 of mark 10, as previously discussed and shown in FIGS. 1 and 2, anchoring element 17 can be attached perpendicularly end-to-end to filament 12 so as to provide mark 10 with an overall "L" shape (not shown).

With reference now to FIG. 3, book 18 is illustrated in fully open (or "reading") condition as to predetermined pages 26 to be marked. The relative length of filament 12 of mark with respect to the thickness of book body 24 when in closed condition is readily apparent. The length of filament 12 is indefinite and can certainly vary somewhat satisfactorily if it is of sufficient length that it can still be securely retained although marking a page near front cover 20 of book 18 (as in FIGS. 1 and 2).

It will be seen that by sliding a finger between two pages 30 which "sandwich" filament 12, the reader can grasp end 14 and lift filament 12 outwardly or toward himself or herself for aligning with apertures 30 prior to passage of free end 14 and a portion of filament 12 through the apertures of preselected pages 26 for repositioning. Such action may entail bringing the enlarged anchoring element 17 into abutment against the corresponding inner margin portion 28*a* of book body 24 and while placing the excess length of mark 10 between the particular confronting pages 26 wherein pages 26 wherein the desired portion of book 18 to be marked is contained.

After repositioning filament portion 12 of mark 10 a substantial length thereof and free end 14 will be snugly held upon closing of book body 24 to be assured of retention of the particular page 24 to be identified pending the reader's return to book 18. Thus, mark 10 is retained against inadvertent displacement so as to reliably "mark" the pages desired and by reason of this formation, book 18 will be easily opened to that place. After the reader has perused the "marked" page 26, it is only necessary by sliding a finger between two pages 26 to pull free end 14 laterally outwardly allowing the pages to be turned freely and permitting drawing once again end 14 through openings 30 and into place for indicating a succeeding page for future reference.

Figure 4:
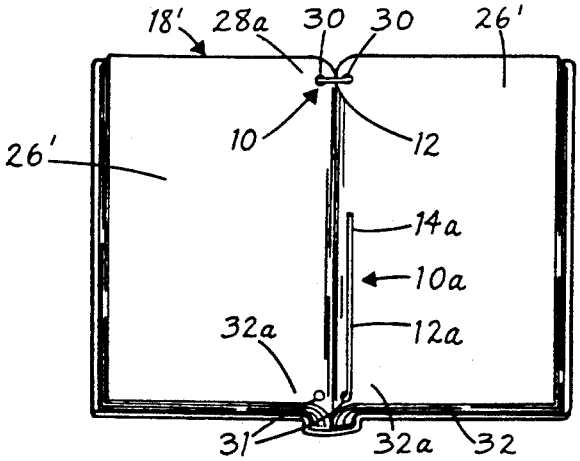
FIG. 4 is a front plan view of a pair of book marks constructed in accordance with and embodying the present invention operatively disposed in a hard back book.

FIG. 4 illustrates a further use of the present invention wherein book 18' is provided with two series of aligned apertures being indicated at 30, 31 and which may respectively be located adjacent the top 28 and lower end 32 of each page 26' at the inner upper margin 28*a* and inner lower margins 32*a* thereof, respectively. Free end 14*a* of mark 10*a*, being of the same character as mark 10, is respectively threaded through each series of apertures 31 in the manner as described above for page marking purposes of, for example, a second reader. Thus, with use of two marks 10, 10*a* it is evident that two different locations in book body 24 may be concurrently "marked".

Figure 5:
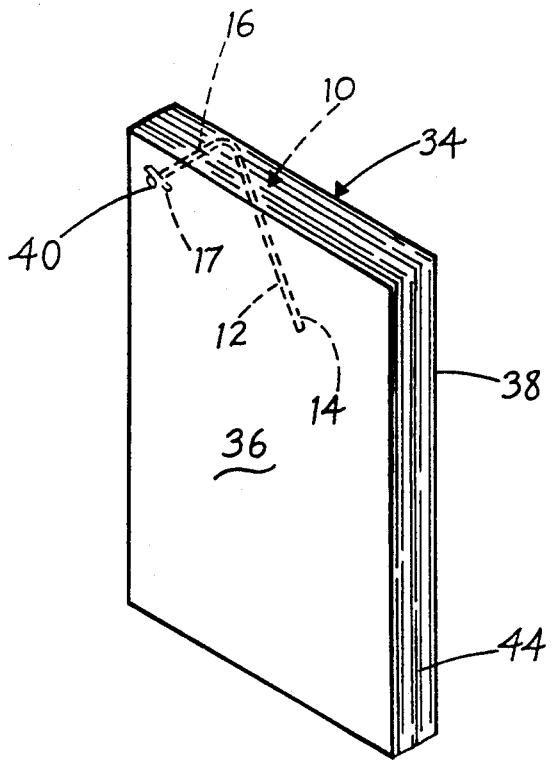
FIG. 5 is a perspective view showing the book mark of FIG. 1 passing through the body of a paper back book as at the time of purchase.

Turning now to FIG. 5, a further use of mark 10 is illustrated wherein the associated book 34 is a paper back, for example, having covers 36, 38 which are each provided with at least one opening 40 in alignment with an intervening series of apertures 42 extending through book body 44. This version of the invention in combination with a book is especially suitable for publishers of books having either so-called paper or other thin, flexible type covers. Thus, for ease of manufacturing, holes 42 may be punched entirely through book 34. Marker 10 is then placed through aligned holes 40 from front to back, so that anchoring element 17 rests inside front cover 36 and free end 14 is inside back cover 38. Thus, in FIG. 5, book mark 10 is shown entirely in phantom as it would not be visible to the puchaser upon initially selecting book 34.

Figure 6:
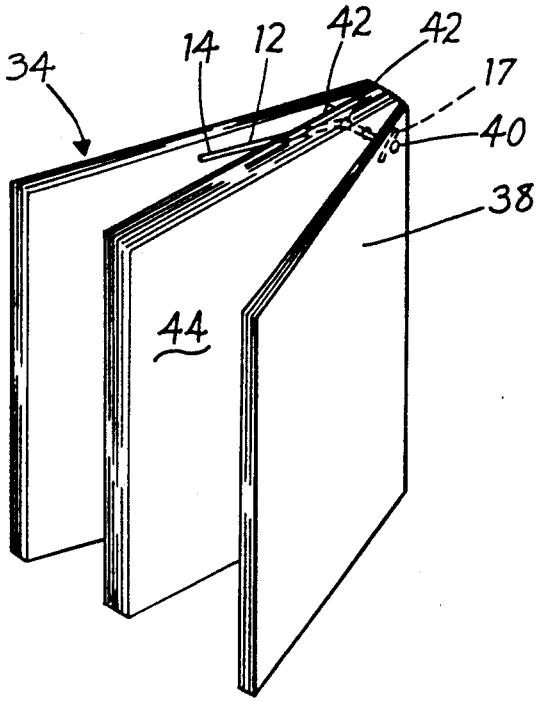
FIG. 6 is a perspective view showing the book mark of FIG. 1 as positioned for use in marking a specific page of the paper back book.

Book 34 will preferably be provided with instructions (not shown) informing the buyer to remove mark 10 from the newly puchased book 34 by grasping and pulling on element 17. The buyer will also be instructed as to repositioning of mark 10 by threading filament 12 from back to front through holes 42 as shown in FIG. 6 which further illustrates book 34 in partially opened position, with mark 10 disposed partially through the series of apertures 42 provided within book body 44 such that free end 14 is between two preselected pages and end 17 (shown in phantom) anchors mark 10 inside the back cover 38.

If desired, mark 10 can conceivably be provided with a tab or tag such as anchoring element 17 at each opposing end thereof so as to not become dislodged from the associated book during handling and shipping. The purchaser can easily be directed to snip off one such tag so as to leave end 14 free and unencumbered to be pulled through apertures 30 so as to permit marking of any desired page 26 as previously discussed.

It is quite apparent from the foregoing that the present invention is extremely versatile, being useful in a variety of fashions with books so that a publisher has at hand a unique means for providing a marker or markers as deemed desirable for the particular book. Although it is intended that book mark 10 be provided for use with paperback books, obviously it is capable of functioning equally well if disposed within a hardback book having penetrated pages, the covers being left unblemished. It is conceivable that mark 10 may be sold separately, as replacements, or as a promotional vehicle and may be translucent or opaque and of any color desired.

It may be seen that although it is preferred to provide and use mark 10 along with a book such as 18, 18', or 34, mark 10 will also function (although less adequately) in a book not provided with through holes 30, 42, if anchoring element 17, 17' is positioned above upper page edge 28 and 12, 12' and free end 14, 14' disposed between predetermined pages 26.

It is evident that the book mark of the present invention overcomes the deficiencies of other book marks of the current time; which latter are often completely physically independent of the book so that the same must be wholly removed each time the book is opened and restored to the place to be marked at the time of the reader's completion of reading. Marks of such type are very easily lost, necessitating replacement, as well as causing more involvement of manipulation and being relatively costly. Other known marks are permanently fixed to a book as by gluing, tying or riveting and thus can not be transferred from book to book without damage to the original attached book. Moreover, the latter known book marks greatly increase the cost of publishing the books associated with them by requiring the addition of various steps and materials which are completely unnecessary for the manufacture and use of the book mark claimed herebelow.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. The combination of a book and a selectively detachable book mark, wherein the combination comprises: a book having front and back covers and a body having opposed front and back end faces and being of a predetermined number of pages contained therebetween, said pages each having an upper edge, a lower edge, and an inner margin, said book further having at least one series of aligned apertures provided through said book pages so as to form a continuous passage within said book through said body; and a book mark which is moisture proof and of thin, stiff character and which is adapted for reasonable flexibility, said book mark comprising an elongated body terminating in opposed free ends and having a length substantially greater than the length of the passage formed by said aligned apertures, said book mark being threaded through said series of apertures in said book body of pages, and an anchoring element fixed to one free end, the anchoring element being of greater cross section than a cross section of said apertures and being adapted for bringing into abutment against the corresponding end face of the book body at the inner margin, to thereby prevent complete passage in one direction of said book mark, said other free end of said book mark projecting beyond the end of the passage opening through the other end face of the book body, and having a cross section smaller than the cross section of said apertures so as to be at all times free to pass through said apertures, and being relatively withdrawn from the book body as the book is continuously opened to the pages perused.

2. The combination of claim 1, wherein said series of aligned apertures is provided solely within the body of pages of said book.

3. The combination of claim 1, wherein the series of aligned apertures is provided within the body of pages and also in each of the book front and back covers, whereby to enhance economy and ease of manufacturing.

4. The combination of claim 1 wherein at least one series of aligned apertures is provided substantially adjacent the upper edge of each of said pages of said book body substantially adjacent the inner margins thereof.

5. The combination of claim 1 wherein a first series of apertures is provided spacedly downward from an upper edge of the pages and a second series of apertures is provided spacedly upward from the lower edge of each of said pages, substantially adjacent the inner margins thereof, there being a book mark provided threadably in each series of apertures.

* * * * *